US011857031B1

(12) United States Patent
Singh

(10) Patent No.: US 11,857,031 B1
(45) Date of Patent: Jan. 2, 2024

(54) ATTACHMENT SYSTEMS FOR ELECTRONIC DEVICES

(71) Applicant: Apple Inc., Cupertino, CA (US)

(72) Inventor: Yuvraj Singh, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 18/115,573

(22) Filed: Feb. 28, 2023

(51) Int. Cl.
*A44B 1/08* (2006.01)
*A44C 5/20* (2006.01)

(52) U.S. Cl.
CPC ..... *A44B 1/08* (2013.01); *A44C 5/2071* (2013.01)

(58) Field of Classification Search
CPC ..... A44B 1/08; A44B 11/22; A44C 5/2071; A44C 5/0053
See application file for complete search history.

(56) References Cited

U.S. PATENT DOCUMENTS 1,503,445 A * 7/1924 Harrison ..... A44C 5/2071 63/3
1,543,399 A * 6/1925 Smith ..... A44C 5/2071 2/322
9,125,460 B2 * 9/2015 Olsen ..... A44C 5/2071
9,615,635 B2 * 4/2017 Argiolas ..... A44C 5/2071
9,737,119 B2 * 8/2017 Lee ..... A61B 5/681
9,803,400 B1 * 10/2017 Willie ..... A44C 5/2071
10,258,115 B2 * 4/2019 Novak ..... A44C 5/185
10,398,200 B2 * 9/2019 Baranski ..... A44C 5/0069
2015/0102075 A1 * 4/2015 Shibuya ..... A44C 5/0053 224/267
2016/0037878 A1 2/2016 Yabe et al.
2016/0334645 A1 * 11/2016 Canada ..... A44C 5/0084
2017/0215530 A1 * 8/2017 Grifoni ..... A44B 11/25
2018/0210400 A1 * 7/2018 Kaneko ..... A44C 5/2071
2022/0338601 A1 * 10/2022 Bravo ..... A44C 5/2071

* cited by examiner

*Primary Examiner* — Robert Sandy
*Assistant Examiner* — Louis A Mercado
(74) *Attorney, Agent, or Firm* — BAKERHOSTETLER

(57) ABSTRACT

Attachment systems for attaching a wearable electronic device to a user including a sizing band and a retaining band are disclosed. The retaining band can include a plug assembly (e.g., actuatable button, retractable arms, etc.) configured to be inserted in a selected eyelet of the sizing band. Upon insertion into the eyelet, the plug assembly can resist unintended separation of the sizing and retaining band by increasing its outer dimension. Release can be achieved by allowing the user to decrease the outer dimension of the plug assembly so that removal from the selected eyelet is easily achieved.

20 Claims, 7 Drawing Sheets

ATTACHMENT SYSTEMS FOR ELECTRONIC DEVICES

TECHNICAL FIELD

The present description relates generally to systems for affixing an electronic device to an object and, more particularly, to mechanisms for removably attaching wearable electronic devices to a user.

BACKGROUND

Some electronic devices may be removably attached to a user. For example, a portable electronic device such as a smart watch can be attached to a user's wrist by joining free ends of a watch band together.

Some watch bands include a two-part clasp such as a tang-type buckling clasp or a snap-fit clasp. Other watch bands include a one-piece clasp (e.g., folding clasp) or an elasticated band. In many cases, these and other conventional watch bands may uncomfortably catch, pinch, and/or pull a user's hair or skin during use, attachment, or detachment. Moreover, conventional watch bands often require multiple steps and/or dexterity to attach or to detach from a user's wrist. A user may ignore these and other disadvantages of conventional watch bands since traditional wristwatches are typically removed and reattached relatively infrequently. However, the same user may be aggravated or inconvenienced with the task of regularly attaching and detaching a smart watch, or other portable electronic device, that may require regular recharging of internal batteries and/or regular connection to a data port of a separate electronic device.

Accordingly, there may be a present need for a watch band suitable for rapid, comfortable, and convenient attachment and detachment from a user's wrist.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
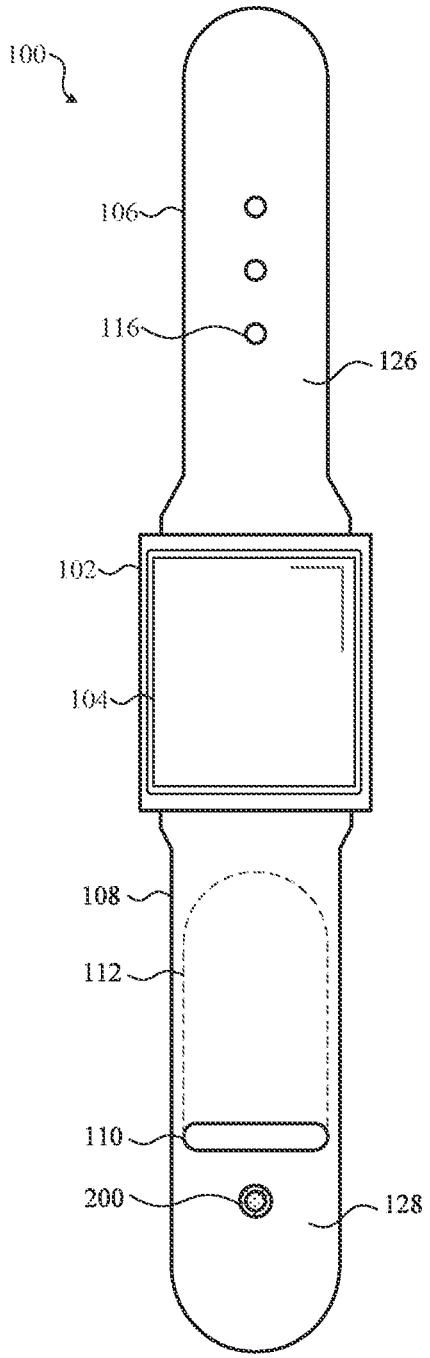
FIG. 1 shows a top view of an example wearable device with a two-band attachment system for securing to a user's wrist, in accordance with one or more implementations of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Some portable electronic devices may be removably attached to a user. For example, a wearable device such as a smart watch can be attached to a user's wrist by joining free ends of a conventional watch band together. By further example, a clasp or an elasticated band may be used to secure the wearable device.

In some cases, a wearable device may need to be regularly removed from the user. For example, many wearable devices include one or more internal batteries that require recharging from time to time. By further example, a wearable device may require a physical connection to a separate electronic device, such as a personal computer, in order to receive updates or other data.

However, it can be desirable to maintain such a wearable device on the user until an appropriate time. For example, a user may wear the device throughout various activities that include significant and frequent movements. By further example, the wearable device may be subject to external forces, such as when the user and/or the wearable device collide with another object, enter water at speed, experience high acceleration, and the like. Release and/or loosening of the wearable device from the user can result in loss of the wearable device and/or a reduced capacity of the wearable device to perform its functions, such as collecting health-related information (e.g., pulse rate, blood oxygen saturation, blood pressure, insulin levels, etc.) or to provide health-related notifications (e.g., prescription timing reminders, medical alerts, medical identification numbers, etc.).

Accordingly, embodiments described herein relate to and include attachment systems suitable for rapid, comfortable, and controlled detachment and reattachment of a wearable device from a user's wrist. In some embodiments, a retaining band of an attachment system can include a plug assembly (e.g., actuatable button, retractable arms, etc.) configured to be inserted in a selected eyelet of a sizing band. Upon insertion into the eyelet, the plug assembly can resist unintended separation of the sizing and retaining band by increasing its outer dimension. Release can be achieved by allowing the user to decrease the outer dimension of the plug assembly so that removal from the selected eyelet is easily achieved.

These and some embodiments are discussed below with reference to FIGS. 1-23. However, those skilled in the art will readily appreciate that the detailed description given herein with respect to these Figures is for explanatory purposes only and should not be construed as limiting.

Figure 2:
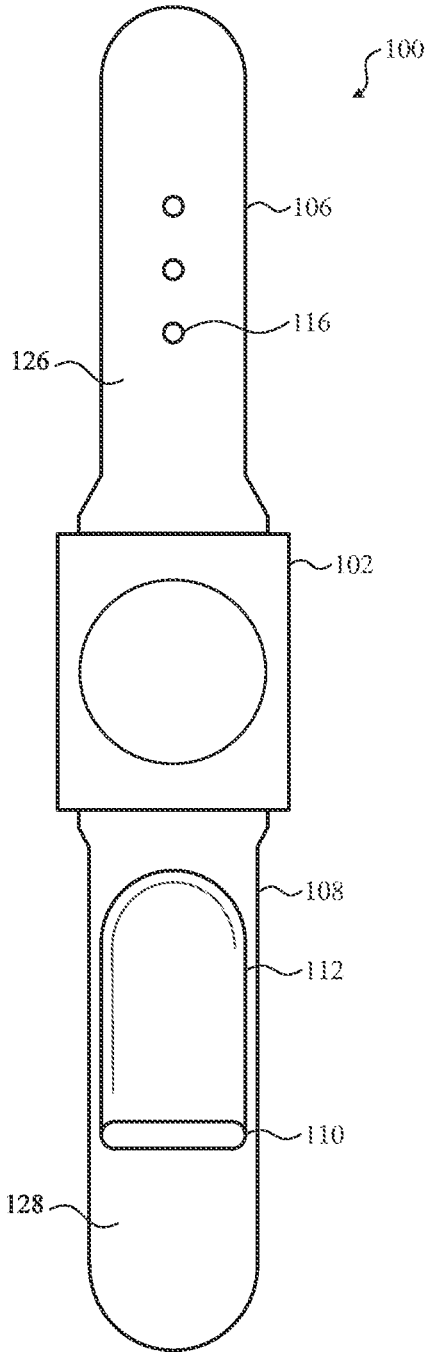
FIG. 2 shows a bottom view of the wearable device of FIG. 1, in accordance with one or more implementations of the subject technology.
Figure 3:
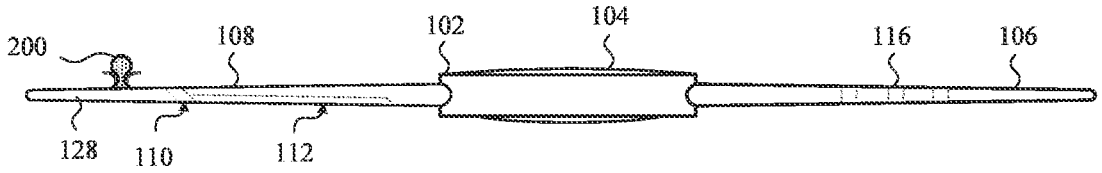
FIG. 3 shows a side view of the wearable device and two-band attachment system of FIG. 1 in an open configuration, in accordance with one or more implementations of the subject technology.
Figure 4:
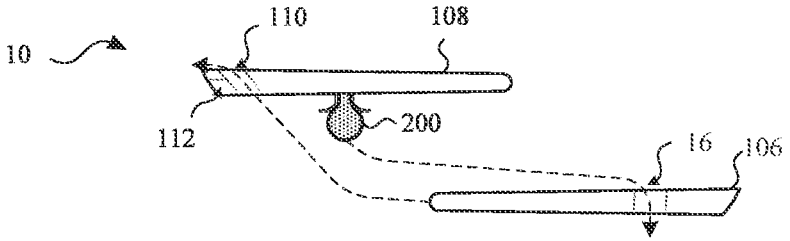
FIG. 4 shows a detail side view of the relative closure paths of the bands of the attachment system of FIG. 1 in an open configuration, in accordance with one or more implementations of the subject technology.

Referring now to FIGS. 1-3, a wearable device can include or be used with a two-part attachment system for securing the wearable device to a user. As shown in FIGS. 1 and 2, wearable device 100 is implemented as a portable electronic device that is adapted to be worn by a user. Some embodiments can implement the wearable device differently. For example, the wearable device can be a smart phone, a gaming device, a digital music player, a sports accessory device, a medical device, a device that provides time and/or weather information, a health assistant, and other types of electronic device suitable for attaching to a user.

Wearable device 100 includes a housing 102 at least partially surrounding a display 104. In some embodiments, display 104 may incorporate an input device configured to receive touch input, force input, and the like. Wearable device 100 may also include one or more buttons or input devices (not shown). Housing 102 can form an outer surface or partial outer surface and protective case for the internal components of wearable device 100. In the illustrated embodiment, housing 102 is formed into a substantially rectangular shape, although this configuration is not required.

Housing 102 can be formed of one or more components operably connected together, such as a front piece and a back piece or a top clamshell and a bottom clamshell. Alternatively, housing 102 can be formed of a single piece (e.g., uniform body or unibody) operably connected to display 104.

Display 104 can be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. A button (not shown) might take the form of a home button, which may be a mechanical button, a soft button (e.g., a button that does not physically move but still accepts inputs), an icon or image on display 104 or on an input region, and so on. Other buttons or mechanisms can be used as input/output devices, such as a speaker, a microphone, an on/off button, a mute button, rotary input, switches, or a sleep button.

Wearable device 100 can be permanently or removably attached to a two-part band system including a sizing band 106 and a retaining band 108. Each of sizing band 106 and retaining band 108 can include a corresponding body that extends away from housing 102. For example, sizing band 106 can include a sizing band body 126 on a first side of housing 102, and retaining band 108 can include a retaining band body 128 on a second side of housing 102, opposite the first side.

Sizing band body 126 and/or retaining band body 128 can be formed from a compliant material that is configured to easily contour to a user's wrist, while retaining stiffness sufficient to maintain the position and orientation of wearable device 100 on the user's wrist. These materials can support a looser attachment to the wrist, which, in many cases, can provide a more comfortable fit. More particularly, the more flexible the compliant material, the tighter the band should be secured to prevent wearable device 100 from sliding or otherwise displacing on the user's wrist. Suitable compliant materials may include plastic, rubber, leather, nylon, canvas or other fibrous, organic, polymeric, or synthetic materials. In some embodiments, sizing band body 126 and/or retaining band body 128 can be formed from a polymer such as a fluoroelastomeric polymer, having a Shore durometer selected for flexibility suitable for easily contouring to a user's wrists and selected for having sufficient stiffness to maintain support the electronic device when attached to a user's wrist. For example, sizing band body 126 and/or retaining band body 128 have a Shore A durometer ranging from 60 to 80 and/or a tensile strength greater than 12 MPa.

As further shown in FIGS. 1 and 2, sizing band 106 may be sized to be inserted through a concealment opening 110 that is formed within retaining band 108. As shown, concealment opening 110 may be substantially lozenge shaped or otherwise complementary to the cross-sectional dimensions of sizing band 106. The height of concealment opening 110 may vary from embodiment to embodiment, but in some embodiments the minimum height of concealment opening 110 is related to the thickness of sizing band 106. For example, if sizing band 106 is thicker than the height of concealment opening 110, the user may find it inconvenient to feed sizing band 106 through concealment opening 110.

After insertion through concealment opening 110, sizing band 106 can slide along a guide bed 112 that is formed in the bottom surface of retaining band 108 (see, e.g., FIG. 2). Guide bed 112 may guide sizing band 106 and prevent sizing band 106, once inserted, from displacing side to side.

The size and/or proportions of guide bed 112 can vary from embodiment to embodiment. For example, in some embodiments, guide bed 112 can be wider than sizing band 106 by a selected amount. By further example, the depth of guide bed 112 can vary along the length of the guide bed.

In some embodiments, guide bed 112 can be configured to extend into half of the thickness of retaining band 108. In some embodiments, guide bed 112 can be configured to extend into a quarter of the thickness of retaining band 108. In some embodiments, guide bed 112 can extend into retaining band 108 by another depth.

In many cases, the depth of guide bed 112 can affect the rigidity of retaining band 108. For example, retaining band with a guide bed extending into half of the retaining band's thickness may be less rigid than a retaining band with a guide bed extending into a quarter of the retaining band's thickness. In other words, the flexibility of certain embodiments of the retaining band can be affected, at least in part, by selecting the depth of the guide bed. Accordingly, certain embodiments can select a target flexibility for the retaining band by selecting a specific depth of the guide bed. In some embodiments, the target flexibility of retaining band 108 (with the guide bed) may be selected to be substantially equal to the flexibility of sizing band 106. In this manner, both bands may have substantially the same flexibility.

Although the embodiments described above relating to the size and/or proportion of guide bed 112 are discussed with respect to depth, one can appreciate that varying other dimensions of guide bed 112 can also affect the flexibility of retaining band 108.

Retaining band 108 may also include a plug assembly 200 that is configured to be inserted within a sizing eyelet 116 of sizing band 106. In many embodiments, sizing band 106 may include more than one sizing eyelet. For example, as shown in FIGS. 1-3, sizing band 106 includes three sizing eyelets. Although the sizing eyelets are illustrated as circular openings within sizing band 106, such a shape is not required. For example, in some embodiments, the sizing eyelet 116 may take a rectangular or oval shape. Furthermore, although the three sizing eyelets of sizing band 106 are shown as evenly distributed along the length of sizing band 106, such a configuration is not required.

As shown in FIG. 3, sizing band 106 and retaining band 108 can be substantially flat, although this configuration is not required. For example, sizing band 106 and retaining band 108 may be formed in a substantially curved shape.

As shown in FIG. 3, plug assembly 200 of retaining band 108 may extend a certain distance from a surface of retaining band body 128. In some embodiments, plug assembly 200 can be insert molded into retaining band body 128. In some embodiments, plug assembly 200 can be secured to the retaining band with a fastener such as a screw or bolt. In many embodiments, plug assembly 200 may be permanently fastened to retaining band body 128, although this is not required. For example, if plug assembly 200 is attached to retaining band body 128 with a fastener, a permanent adhesive may be used to make the connection permanent. Alternatively, if a permanent adhesive is not used, plug assembly 200 can be removed, replaced, or otherwise disconnected from retaining band body 128 by removing the fastener.

Figure 5:
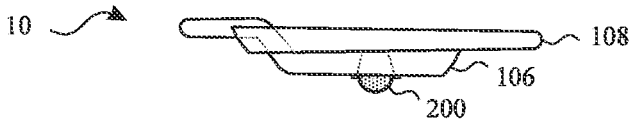
FIG. 5 shows a detail side view of the relative closure paths of the bands of the attachment system of FIG. 1 in a closed configuration, in accordance with one or more implementations of the subject technology.
Figure 6:
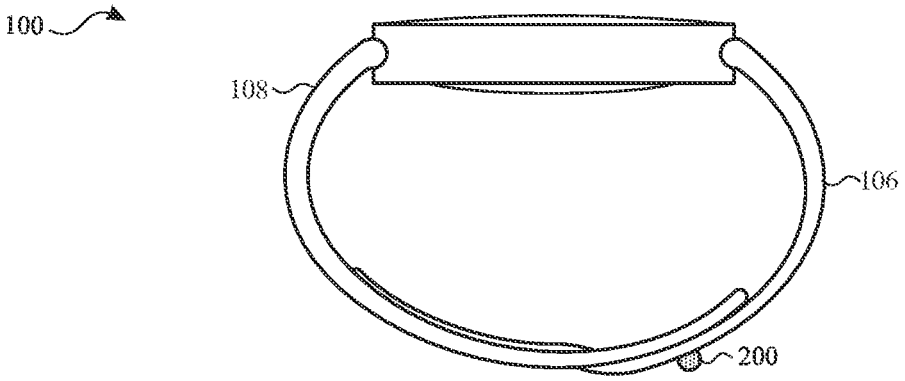
FIG. 6 shows a side view of the wearable device of FIG. 1 in a closed configuration, in accordance with one or more implementations of the subject technology.

As described above and shown in FIGS. 4-6, the two-band attachment system 10 can be secured to a user by inserting sizing band 106 into concealment opening 110 and into guide bed 112 while thereafter or simultaneously inserting plug assembly 200 into a sizing eyelet 116. As shown in FIG. 5, once inserted, sizing band 106 may rest within guide bed 112. As shown in FIG. 6, attachment system 10 can then form at least a portion of a closed loop so that wearable device 100 can be secured to a wrist of a user.

Figure 7:
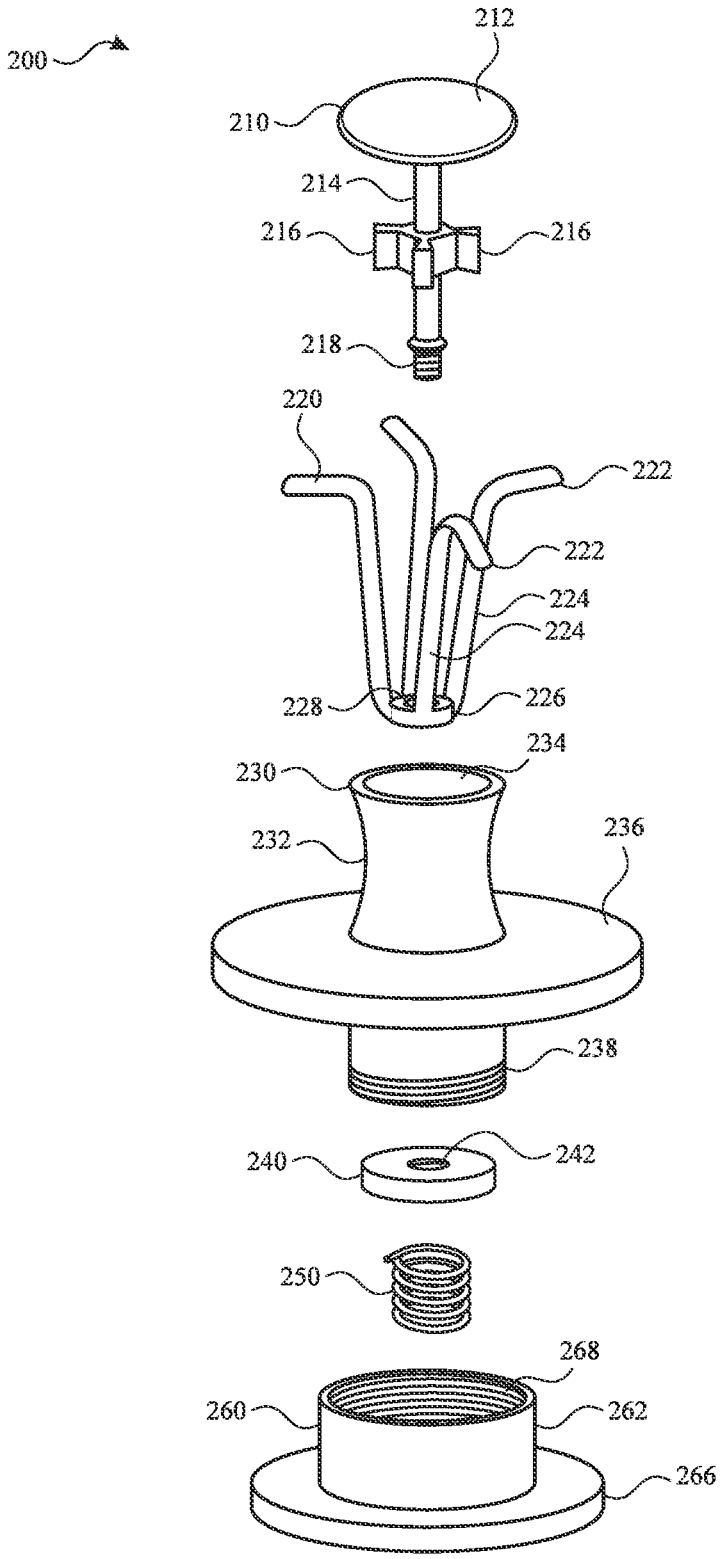
FIG. 7 shows an exploded perspective view of a plug assembly, in accordance with one or more implementations of the subject technology.

Referring now to FIG. 7, a plug assembly 200 can include various components that interact with each other to controllably secure and release bands from each other. Plug assembly 200 can include a button 210, a stopper 220, and a post 230. Plug assembly 200 can further include a spacer 240, a spring 250, and a base 260.

As shown in FIG. 7, button 210 can define a topmost portion of plug assembly 200 for access and actuation by a user. For example, at least a portion of button 210 can be exposed for access and actuation by a user. Button 210 can include a stem 214 for extending at least partially within a channel 234 of post 230 and a head 212 for extending outside of channel 234. Head 212 can define a topmost portion of button 210, for example, at an end thereof. At an opposite end of button 210, button 210 can include one or more button engagers 218 for coupling button 210 to another component, such as spacer 240 at one or more spacer engagers 242. Button engagers 218 and/or spacer engagers 242 can include threading, snaps, pins, clips, fasteners, and the like to couple button 210 to spacer 240.

As further shown in FIG. 7, stopper 220 can provide variable engagement capabilities in different configurations thereof for controllably securing and/or releasing another band. stopper 220 can include multiple beams 224 extending generally longitudinally from a hub 226. Each of beams 224 can terminate in an arm 222. While four beams and arms are illustrated, it will be understood that stopper 220 can include any number of beams and arms. For example, the stopper 220 can include 1, 2, 3, 4, 5, 6, 7, 8, 9, or greater than 9 beams and arms. Arms 222 can extend generally radially outwardly from each other and/or a central axis of plug assembly 200. At least a portion of button 210 (e.g., stem 214 and/or button engagers 218) can extend through an opening 228 in hub 226 of stopper 220. As such, stopper 220 can be coupled to button 210 and/or spacer 240, such that button 210, stopper 220, and/or spacer 240 can move together along a central axis of plug assembly 200, for example, when actuated by a user by application of a force at head 212.

Button 210 can further include a stabilizer coupled to stem 214 of button 210. The stabilizer can include one or more rails 216 that separate beams 224 of stopper 220 from each other. For example, rails 216 can protrude radially outwardly from stem 214, with gaps formed between circumferentially adjacent pairs of rails 216. As such, each beam 224 of stopper 220 can extend generally longitudinally within a corresponding gap between a pair of rails 216.

As further shown in FIG. 7, post 230 can at least partially enclose one or more other components of plug assembly 200 and provide a structure for extending through an eyelet. Post 230 can define a post neck 232 that extends longitudinally and defines at least a portion of a channel 234 extending through post 230. Channel 234 can open at an end of post 230, for example at post neck 232. At least a portion of button 210 and stopper 220 can be movably positioned within channel 234. Post 230 can further include a post flange 236. Post neck 232 can be sized to extend within an eyelet of another band, and post flange 236 can be sized to prevent further extension through the eyelet. For example, post neck 232 can have a post neck outer dimension, and post flange 236 can have a post flange outer dimension, greater than the post neck outer dimension.

As further shown in FIG. 7, base 260 can be coupled to post 230. Base 260 can include a base neck 262 and a base flange 266. Base neck 262 can be sized to extend within a corresponding band body, and base flange 266 can be sized to prevent further extension through the corresponding band body. For example, base neck 262 can have a base neck outer dimension, and base flange 266 can have a base flange outer dimension, greater than the base neck outer dimension. Base 260 can include one or more base engagers 268 for coupling base 260 to another component, such as post 230 at one or more post engagers 238. Base engagers 268 and/or post engagers 238 can include threading, snaps, pins, clips, fasteners, and the like to couple base 260 to post 230.

As further shown in FIG. 7, spacer 240 can be positioned between post 230 and base 260. Spacer 240 can be coupled to stem 214 of button 210 as stem 214 extends through hub 226 of stopper 220. Spacer can be enclosed within a corresponding portion of post 230 and/or base 260.

As further shown in FIG. 7, spring 250 can be positioned between post 230 and base 260. For example, spring 250 can be positioned between spacer 240 and base 260, such that spring 250 biases spacer 240 away from base 260. Accordingly, spacer 240 and components coupled thereto (e.g., button 210 and/or stopper 220) can be biased by spring 250 away from base 260 and into an extended configuration. Spring 250 can be enclosed within a corresponding portion of post 230 and/or base 260.

Figure 8:
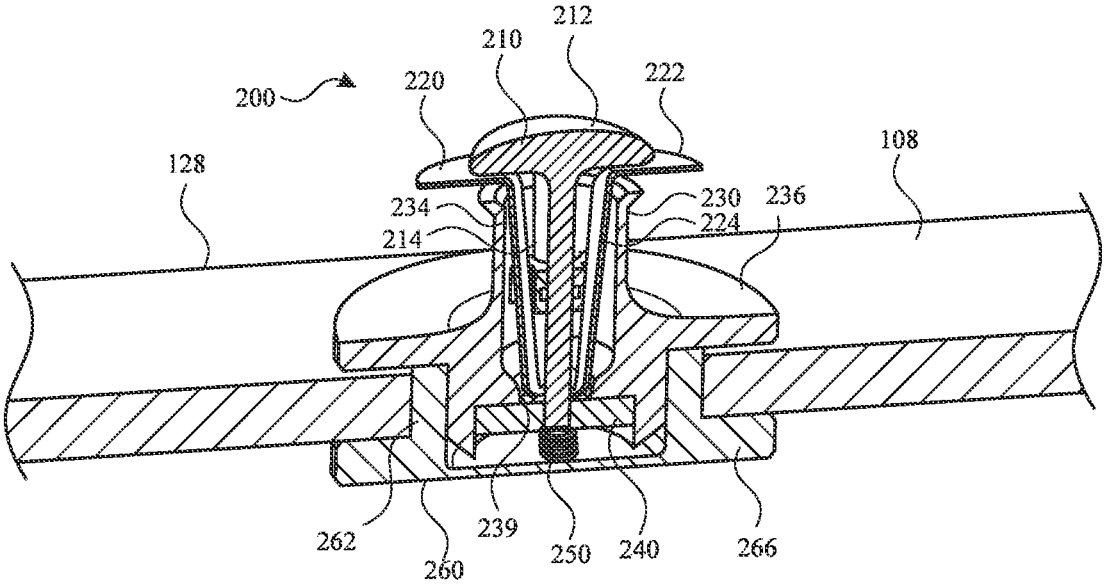
FIG. 8 shows a perspective sectional view of the plug assembly of FIG. 7 in an assembled configuration, in accordance with one or more implementations of the subject technology.

Referring now to FIG. 8, plug assembly 200 can be assembled to provide controlled transitions between different configurations thereof. As shown in FIG. 8, a portion of retaining band body 128 can be positioned between post flange 236 of post 230 and base flange 266 of base 260. Base neck 262 of base 260 can abutting post flange 236. As such, as post 230 is secured to base 260, portions thereof can extend through an opening in retaining band body 128 and secure thereto while post 230 remains secured to base 260.

As further shown in FIG. 8, at least a portion of button 210 (e.g., stem 214) and/or a portion of stopper 220 (e.g., beams 224) can be positioned within channel 234 of post 230. As further shown in FIG. 8, at least a portion of button 210 (e.g., head 212) and/or a portion of stopper 220 (e.g., arms 222) can be positioned outside channel 234 of post 230. For example, head 212 of button 210 and arms 222 of stopper 220 can be positioned outside channel 234 such that they extend beyond an end of post 230 (e.g., above a top side thereof). Arms 222 can be positioned axially between head 212 of button 210 and an end of post 230.

Button 210 and stopper 220 can be configured to move along an axis of channel 234. As button 210 is actuated, stopper 220 can move with button 210 further into channel 234. Arms 222 of stopper 220 can be configured to move radially inwardly (i.e., towards each other) in response to actuation (e.g., axial translation) of button 210 and stopper 220 along the axis of channel 234. For example, post 230 can define a shoulder 239 extending radially inwardly at a region of channel 234. Shoulder 239 can interact with stopper 220 (e.g., beams 224) as stopper 220 moves with button 210 along the axis of channel 234. Shoulder 239 can define a radially smaller inner dimension of channel 234 than at other regions of channel 234. Additionally or alternatively, stopper 220 can interact with other portions of post 230, such as an end thereof at which channel 234 terminates.

Figure 9:
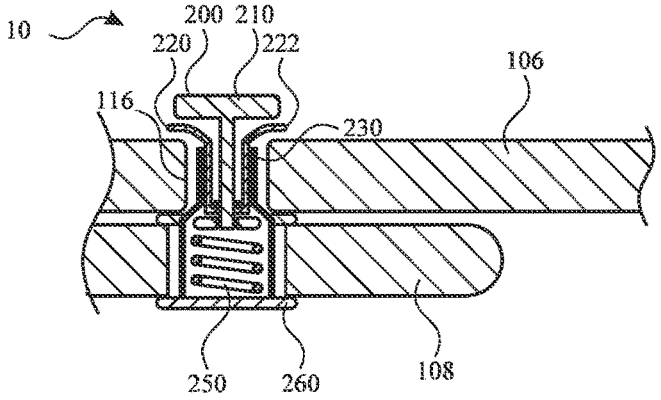
FIG. 9 shows a side sectional view of bands of an attachment system with a plug assembly in an extended configuration, in accordance with one or more implementations of the subject technology.
Figure 10:
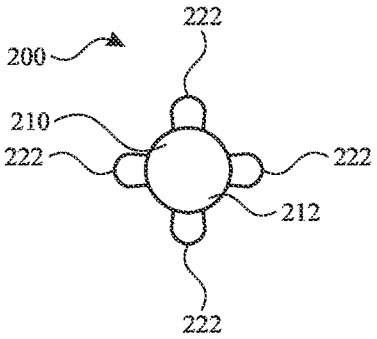
FIG. 10 shows a top view of the plug assembly of the attachment system of FIG. 9 with the plug assembly in the extended configuration, in accordance with one or more implementations of the subject technology, in accordance with one or more implementations of the subject technology.

Referring now to FIGS. 9-13, plug assembly 200 can be operated to transition between an extended configuration for securing bands to each other and a retracted configuration for releasing sizing band 106 and retaining band 108 from each other. FIGS. 9 and 10 show, respectively, side sectional and top views of plug assembly 200 in an extended configuration. In the extended configuration, arms 222 can define an extended outer (e.g., radial) dimension that is larger than in the retracted configuration. For example, arms 222 can extend radially beyond a perimeter of head 212 of button 210. By further example, arms 222 can extend radially beyond an outer dimension of eyelet 116 of sizing band 106. Accordingly, arms 222 of plug assembly 200 can resist removal of plug assembly 200 from eyelet 116 while in the extended configuration.

Figure 11:
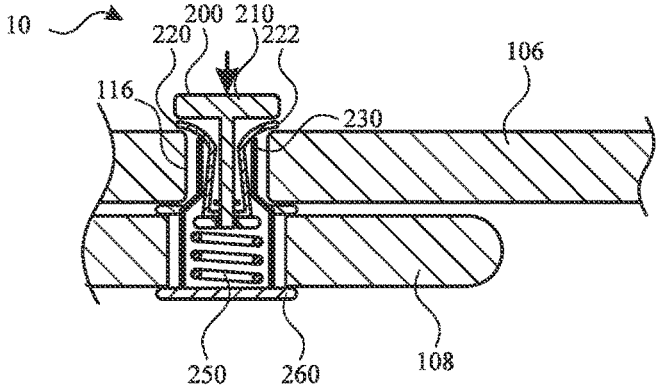
FIG. 11 shows a side sectional view of the bands of the attachment system of FIG. 9 with the plug assembly in a retracted configuration, in accordance with one or more implementations of the subject technology.
Figure 12:
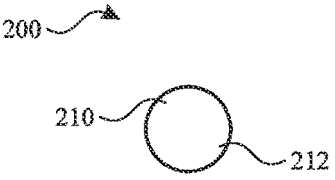
FIG. 12 shows a top view of the plug assembly of the attachment system of FIG. 11 with the plug assembly in the retracted configuration, in accordance with one or more implementations of the subject technology, in accordance with one or more implementations of the subject technology.

FIGS. 11 and 12 show, respectively, side sectional and top views of plug assembly 200 in a retracted configuration. Button 210 can be actuated with an external force to move button 210 and stopper 220 within post 230 (e.g., along a central axis). As button 210 and stopper 220 move within post 230, arms 222 can be transitioned from the extended configuration to the retracted configuration, as described herein. In the retracted configuration, arms 222 can define a retracted outer (e.g., radial) dimension that is smaller than in the extended configuration. For example, arms 222 can be radially within (i.e., not extending radially beyond) the perimeter of head 212 of button 210. By further example, arms 222 can be radially within (i.e., not extending radially beyond) an outer dimension of eyelet 116 of sizing band 106. Accordingly, arms 222 of plug assembly 200 can allow removal of plug assembly 200 from eyelet 116 while in the retracted configuration.

Figure 13:
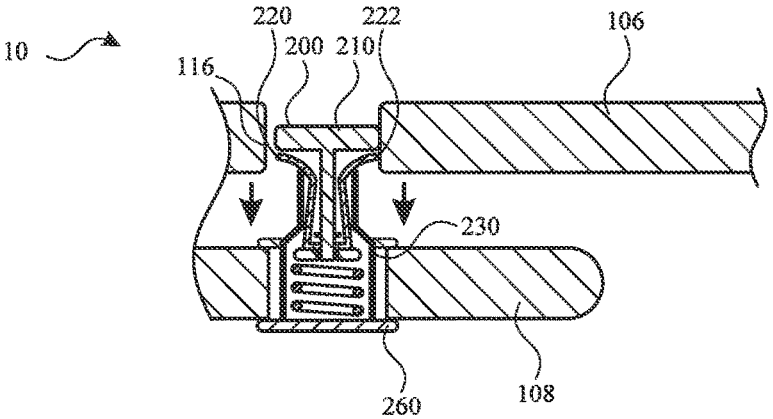
FIG. 13 shows a side sectional view of the bands of the attachment system of FIGS. 9 and 11 with the plug assembly in the retracted configuration, in accordance with one or more implementations of the subject technology.

As shown in FIG. 13, while button 210 is actuated and stopper 220 is in the retracted configuration (e.g., with arms 222 radially retracted), plug assembly 200 can facilitate removal from eyelet 116. While plug assembly 200 is able to move through eyelet 116, retaining band 108 can be moved away from sizing band 106. Thereafter, plug assembly 200 can be released (e.g., unactuated) to allow a return to the extended configuration.

Figure 14:
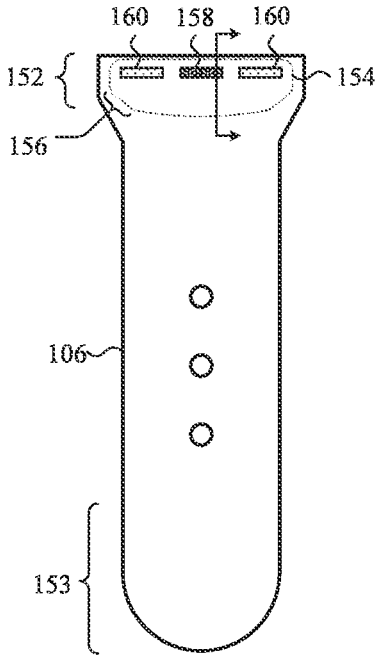
FIG. 14 shows a top view of one band of a two-band attachment system, showing a structural insert, in accordance with one or more implementations of the subject technology.

Referring now to FIGS. 14-17, each of the bands of an attachment system can attach to a housing of the wearable device by insertion into a channel thereof. FIG. 14 shows a top view of a sizing band 106 of a two-band attachment system showing a structural insert. Sizing band 106 may have a lug 152 that is configured to be inserted into channel (not shown) of a wearable device housing. Opposite lug 152 may be an insert portion 153.

Lug 152 can include a structural insert 154. Structural insert 154 can provide structural and mechanical stability to lug 152. In many embodiments, structural insert 154 may be insert molded into lug 152. Lug 152 may also include a retractable detent 158. Retractable detent 158 can be positioned in the center of lug 152, as illustrated, although this configuration is not required. In some embodiments, more than one retractable detent can be used.

Lug 152 may also include one or more friction pads 160. Friction pads 160 may be configured to provide a high friction relationship between lug 152 and the interior of the channel of the housing (not shown). In this manner, friction pads 160 prevent or reduce unexpected or undesired translation of lug 152 within the channel (not shown). In some embodiments, friction pads 160 may be co-molded with sizing band 106. In some embodiments, friction pads 160 can be insert molded in sizing band 106, inserted after molding of sizing band 106, or positioned using any suitable method.

Figure 15:
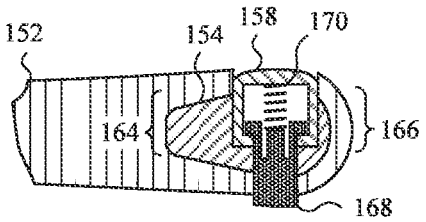
FIG. 15 shows a side cross-section view of the band of FIG. 14 taken along section A-A, showing a retractable detent within the structural insert, in accordance with one or more implementations of the subject technology.

FIG. 15 shows a side cross-section view of the band of FIG. 14 taken along section A-A, showing retractable detent 158 within structural insert 154. In these embodiments, structural insert 154 may include an opening or other structure for supporting the structural insert. Retractable detent 158 may extend a certain distance from the top surface of lug 152. In some embodiments, retractable detent 158 may be disposed so as to be substantially flush with the top surface of lug 152.

Also shown in the illustrated cross-section are two portions of structural insert 154, identified as a front smooth portion 164 and a back smooth portion 166. Front smooth portion 164 may be implemented as a taper extending into the length of sizing band 106. Front smooth portion 164 may also have substantially rounded edges. Back smooth portion 166 may be implemented as a substantially rounded surface. As noted with respect to other smoothed surfaces of structural insert 154, the front and back smooth portions 164, 166 may prevent concentration of stress upon bending or deflection of sizing band 106.

As further shown in FIG. 15, a foot portion 168 may extend a certain distance from the bottom surface of lug 152 and may be operably associated with retractable detent 158. In some embodiments, foot portion 168 may be positioned opposite retractable detent 158. For example, as illustrated foot portion 168 is directly below retractable detent 158. In these and related embodiments, foot portion 168 can interlock with a portion of retractable detent 158. As illustrated, the foot portion can include a flanged portion that interlocks with a corresponding flange portion of retractable detent 158.

In some embodiments, foot portion 168 may be mechanically coupled to retractable detent 158 by a spring member 170. Spring member 170 can be any suitable type of springing or elastic member such as a metal spring. Spring member 170 may be positioned between foot portion 168 and retractable detent 158 such that when foot portion 168 is pushed or otherwise forced into the body of lug 152, the additional compression applied to spring member 170 may cause retractable detent 158 to exhibit an outward force on the upper surface of the interior sidewall of the band retaining channel.

Figure 16:
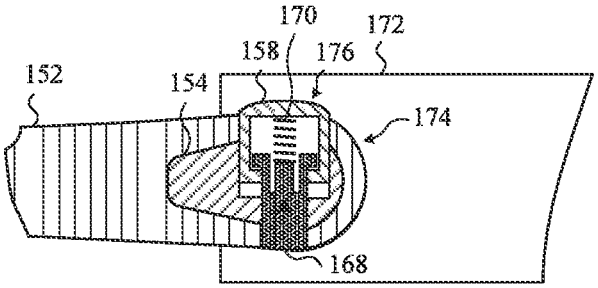
FIG. 16 shows a side cross-section view of the band of FIG. 14 taken along section A-A, showing the band inserted within a tapered channel of a rigid housing, in accordance with one or more implementations of the subject technology.
Figure 17:
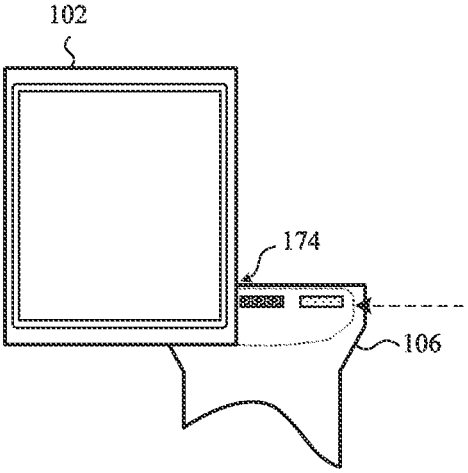
FIG. 17 shows a top view of the band of FIG. 14 being inserted into a band-retaining channel, in accordance with one or more implementations of the subject technology.

As shown in FIGS. 16 and 17, when lug 152 is inserted into a channel 174 of housing 102, foot portion 168 is pushed inward (relative to lug 152) by the bottom interior sidewall of channel 174. As noted above, when foot portion 168 is pushed into the body of lug 152, the additional tension imparted to spring member 170 is transferred to retractable detent 158. As lug 152 is slid further into channel 174 (see, e.g., FIG. 17), retractable detent 158 eventually may be positioned below a detent recess 176 that is formed within the top sidewall of channel 174. Once positioned below detent recess 176, retractable detent 158 may, as a result of the force of spring member 170, thrust upward to occupy detent recess 176. In this manner, retractable detent 158 provides a temporary locking mechanism that secures sizing band 106 within channel 174.

Referring now to FIGS. 18-23, the bands of an attachment system can overlap while coupled together. Some embodiments described herein relate to a guide bed formed within a bottom surface of a retaining band. For example, FIG. 18-21 shows a top view of retaining band 108 of attachment system 10 showing a concealment opening 110 and a plug assembly 200.

As noted with respect to further embodiments described herein, concealment opening 110 of retaining band 108 may be positioned and sized to receive a portion of a sizing band 106 (see, e.g., FIGS. 21-23) of attachment system 10. Similarly, plug assembly 200 may be configured to be received and secure itself within an eyelet of sizing band 106 (see, e.g., FIG. 21-23).

Figure 18:
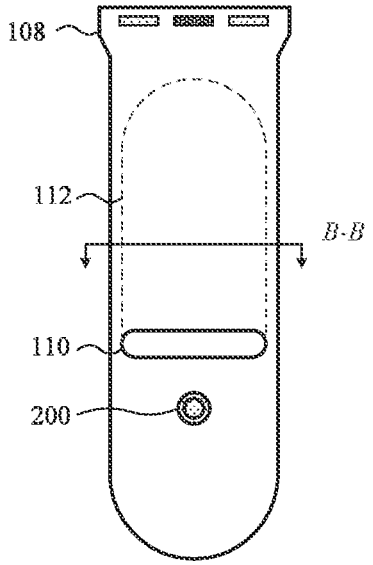
FIG. 18 shows a top view of one band of a two-band attachment system showing a concealment opening and a post assembly, in accordance with one or more implementations of the subject technology.
Figure 19:
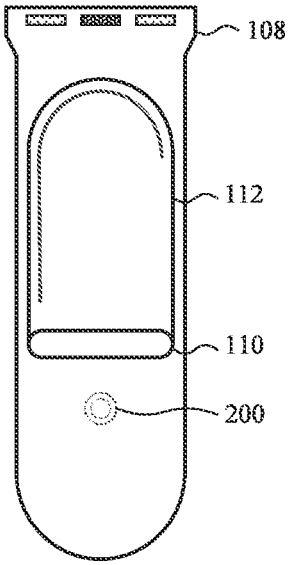
FIG. 19 shows a bottom view of the band of FIG. 18 showing a guide bed formed into the bottom surface of the band, in accordance with one or more implementations of the subject technology.
Figure 20:
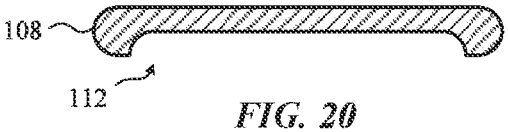
FIG. 20 shows a side cross-section view of the band of FIG. 18 taken along section B-B showing the guide bed of FIGS. 18-19 formed into the bottom surface of the band
Figure 21:
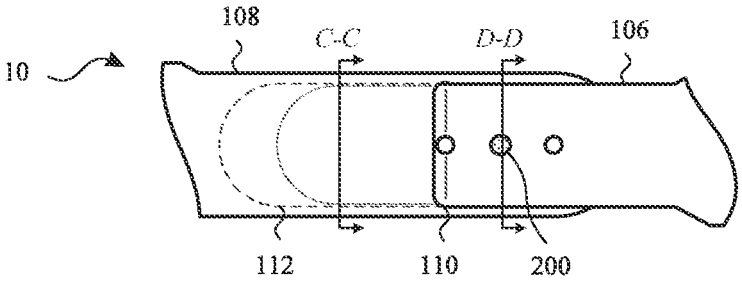
FIG. 21 shows a top view of the two-band attachment system of FIG. 18, shown in a closed configuration, in accordance with one or more implementations of the subject technology.
Figure 22:
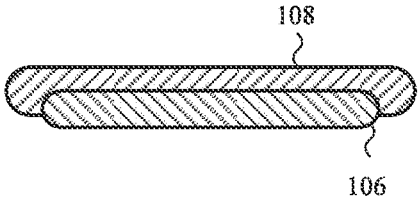
FIG. 22 shows a side cross-section view of the two-band attachment system of FIG. 21 taken along section C-C showing one band end occupying a portion of the guide bed shown in FIGS. 18-21, in accordance with one or more implementations of the subject technology.
Figure 23:
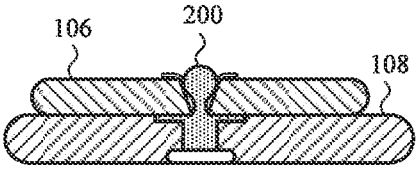
FIG. 23 shows a side cross-section view of the two-band attachment system of FIG. 21 taken along section D-D showing the post assembly of FIG. 21 inserted within an eyelet, in accordance with one or more implementations of the subject technology.

As shown in FIGS. 18-21, guide bed 112 is formed, recessed, into the bottom surface of retaining band 108. In many embodiments, guide bed 112 may be adapted to receive an inserted length of a sizing band. In many cases, and as illustrated, guide bed 112 may be longitudinally centered along the bottom surface of retaining band 108. In addition, guide bed 112 may at least partially retain an inserted length of sizing band 106 in place behind retaining band 108. FIG. 21 shows a top view of the two-band attachment system of FIG. 18, shown in a closed configuration, with the insert portion of sizing band 106 received through concealment opening 110 into guide bed 112. FIG. 22 shows a side cross-section view of the two-band attachment system of FIG. 21 taken along section C-C showing sizing band 106 below retaining band 108, partially received within guide bed 112. FIG. 23 shows a side cross-section view of the two-band attachment system of FIG. 21 taken along section D-D showing plug assembly 200 received and secured through a sizing eyelet of sizing band 106, which in this cross section is positioned above retaining band 108. In some embodiments, guide bed 112 may be formed as a pocket within retaining band 108.

Accordingly, embodiments of the present disclosure provide attachment systems for attaching a wearable electronic device to a user including a sizing band and a retaining band. The retaining band can include a plug assembly (e.g., actuatable button, retractable arms, etc.) configured to be inserted in a selected eyelet of the sizing band. Upon insertion into the eyelet, the plug assembly can resist unintended separation of the sizing and retaining band by increasing its outer dimension. Release can be achieved by allowing the user to decrease the outer dimension of the plug assembly so that removal from the selected eyelet is easily achieved.

Various examples of aspects of the disclosure are described below as clauses for convenience. These are provided as examples, and do not limit the subject technology.

Clause A: an attachment system for a watch, the attachment system comprising: a sizing band comprising a sizing band body defining at least one opening extending through the sizing band body; and a retaining band comprising a retaining band body and a plug assembly extending from a surface of the retaining band body, the plug assembly being configured to extend entirely through a selected one of the at least one opening, the plug assembly being configured to transition between: an extended configuration having an extended outer dimension; and a retracted configuration having a retracted outer dimension that is smaller than the extended outer dimension.

Clause B: a plug assembly for a retaining band, the plug assembly comprising: a post defining a channel extending through the post; a button comprising a stem at least partially within the channel and a head outside of the channel; and a stopper partially within the channel and comprising multiple arms extending radially outwardly from each other, wherein the button and the stopper are configured to move along an axis of the channel.

Clause C: a plug assembly for a retaining band, the plug assembly comprising: a post defining a channel extending into the post from an end of the post; a button comprising a head outside of the channel; and a stopper comprising multiple arms extending radially outwardly from each other, the multiple arms being positioned axially between the head of the button and the end of the post, wherein stopper is configured to transition between: an extended configuration in which the multiple arms extend radially beyond a perimeter of the head of the button; and a retracted configuration in which the multiple arms are radially within the perimeter of the head of the button.

One or more of the above clauses can include one or more of the features described below. It is noted that any of the following clauses may be combined in any combination with each other, and placed into a respective independent clause, e.g., clause A, B, or C.

Clause 1: the plug assembly comprises: a post defining a channel extending through the post; a button comprising a stem at least partially within the channel and a head outside of the channel; and a stopper partially within the channel and comprising multiple arms extending radially outwardly from each other, wherein the button and the stopper are configured to move along an axis of the channel to transition the plug assembly between the extended configuration and the retracted configuration.

Clause 2: the multiple arms of the stopper are configured to move radially in response to movement of the button and the stopper along the axis of the channel.

Clause 3: in the extended configuration, the multiple arms extend radially beyond a perimeter of the head of the button; and in the retracted configuration, the multiple arms are radially within the perimeter of the head of the button.

Clause 4: the post comprises a post flange and the plug assembly further comprises a base coupled to the post and comprising a base flange, wherein a portion of the retaining band body is between the post flange and the base flange.

Clause 5: the sizing band further comprises: an insert end; a sizing band lug opposite the insert end and configured to slide within a first channel defined by a housing of the watch; and a structural insert disposed within the lug.

Clause 6: the retaining band further comprises: a retaining band lug configured to slide within a second channel defined by the housing of the watch; a concealment opening extending from a top surface of the retaining band to a bottom surface of the retaining band and configured to receive the insert end therethrough; and a recess formed in the bottom surface of the retaining band and sized to at least partially receive a depth of the sizing band upon insertion of the insert end.

Clause 7: the multiple arms of the stopper are configured to move radially in response to movement of the button and the stopper along the axis of the channel.

Clause 8: the post further defines a shoulder extending radially inwardly at the channel, the shoulder being configured to interact with the stopper in response to movement of the button and the stopper along the axis of the channel.

Clause 9: the post comprises a post neck having a post neck outer dimension and a post flange having a post flange outer dimension, greater than the post neck outer dimension.

Clause 10: a base coupled to the post, wherein the base comprises a base neck abutting the post flange and having a base neck outer dimension and a base flange having a base flange outer dimension, greater than the base neck outer dimension.

Clause 11: a spacer between the post and the base, the spacer being coupled to the stem of the button, the stem extending through a portion of the stopper.

Clause 12: a spring between the post and the base and biasing the spacer away from the base.

Clause 13: a stabilizer coupled to the stem of the button, the stabilizer comprising rails that separate the arms from each other.

Clause 14: the multiple arms are positioned axially between the head of the button and an end of the post.

Clause 15: the multiple arms of the stopper are configured to transition between the extended configuration and the retracted configuration in response to movement of the button and the stopper along an axis of the channel.

Clause 16: the post further defines a shoulder extending radially inwardly at the channel, the shoulder being configured to transition the multiple arms between the extended configuration and the retracted configuration in response to movement of the button and the stopper along an axis of the channel.

Clause 17: a spring configured to bias the stopper toward the extended configuration.

As described above, one aspect of the present technology may include the gathering and use of data available from various sources. The present disclosure contemplates that in some instances, this gathered data may include personal information data that uniquely identifies or can be used to contact or locate a specific person. Such personal information data can include demographic data, location-based data, telephone numbers, email addresses, twitter ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users.

Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services, the present technology can be configured to allow users to select to "opt in" or "opt out" of participation in the collection of personal information data during registration for services or anytime thereafter. In another example, users can select not to provide mood-associated data for targeted content delivery services. In yet another example, users can select to limit the length of time mood-associated data is maintained or entirely prohibit the development of a baseline mood profile. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users by inferring preferences based on non-personal information data or a bare minimum amount of personal information, such as the content being requested by the device associated with a user, other non-personal information available to the content delivery services, or publicly available information.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. An attachment system for a watch, the attachment system comprising:

a sizing band comprising a sizing band body defining at least one opening extending through the sizing band body; and a retaining band comprising a retaining band body and a plug assembly extending from a surface of the retaining band body, the plug assembly being configured to extend entirely through a selected one of the at least one opening, the plug assembly being configured to transition between:

an extended configuration having an extended outer dimension; and a retracted configuration having a retracted outer dimension that is smaller than the extended outer dimension.

2. The attachment system of claim 1, wherein the plug assembly comprises:

a post defining a channel extending through the post;

a button comprising a stem at least partially within the channel and a head outside of the channel; and a stopper partially within the channel and comprising multiple arms extending radially outwardly from each other, wherein the button and the stopper are configured to move along an axis of the channel to transition the plug assembly between the extended configuration and the retracted configuration.

3. The plug assembly of claim 2, wherein the multiple arms of the stopper are configured to move radially in response to movement of the button and the stopper along the axis of the channel.

4. The plug assembly of claim 2, wherein:

in the extended configuration, the multiple arms extend radially beyond a perimeter of the head of the button; and in the retracted configuration, the multiple arms are radially within the perimeter of the head of the button.

5. The plug assembly of claim 2, wherein the post comprises a post flange and the plug assembly further comprises a base coupled to the post and comprising a base flange, wherein a portion of the retaining band body is between the post flange and the base flange.

6. The attachment system of claim 1, wherein the sizing band further comprises:

an insert end;

a sizing band lug opposite the insert end and configured to slide within a first channel defined by a housing of the watch; and a structural insert disposed within the lug.

7. The attachment system of claim 6, wherein the retaining band further comprises:

a retaining band lug configured to slide within a second channel defined by the housing of the watch;

a concealment opening extending from a top surface of the retaining band to a bottom surface of the retaining band and configured to receive the insert end therethrough; and a recess formed in the bottom surface of the retaining band and sized to at least partially receive a depth of the sizing band upon insertion of the insert end.

8. A plug assembly for a retaining band, the plug assembly comprising:

a post defining a channel extending through the post;

a button comprising a stem at least partially within the channel and a head outside of the channel; and a stopper partially within the channel and comprising multiple arms extending radially outwardly from each other, wherein the button and the stopper are configured to move along an axis of the channel.

9. The plug assembly of claim 8, wherein the multiple arms of the stopper are configured to move radially in response to movement of the button and the stopper along the axis of the channel.

10. The plug assembly of claim 8, wherein the post further defines a shoulder extending radially inwardly at the channel, the shoulder being configured to interact with the stopper in response to movement of the button and the stopper along the axis of the channel.

11. The plug assembly of claim 8, wherein the post comprises a post neck having a post neck outer dimension and a post flange having a post flange outer dimension, greater than the post neck outer dimension.

12. The plug assembly of claim 11, further comprising a base coupled to the post, wherein the base comprises a base neck abutting the post flange and having a base neck outer dimension and a base flange having a base flange outer dimension, greater than the base neck outer dimension.

13. The plug assembly of claim 12, further comprising a spacer between the post and the base, the spacer being coupled to the stem of the button, the stem extending through a portion of the stopper.

14. The plug assembly of claim 13, further comprising a spring between the post and the base and biasing the spacer away from the base.

15. The plug assembly of claim 8, further comprising a stabilizer coupled to the stem of the button, the stabilizer comprising rails that separate the arms from each other.

16. The plug assembly of claim 8, wherein the multiple arms are positioned axially between the head of the button and an end of the post.

17. A plug assembly for a retaining band, the plug assembly comprising:

a post defining a channel extending into the post from an end of the post;

a button comprising a head outside of the channel; and a stopper comprising multiple arms extending radially outwardly from each other, the multiple arms being positioned axially between the head of the button and the end of the post, wherein stopper is configured to transition between:

an extended configuration in which the multiple arms extend radially beyond a perimeter of the head of the button; and a retracted configuration in which the multiple arms are radially within the perimeter of the head of the button.

18. The plug assembly of claim 17, wherein the multiple arms of the stopper are configured to transition between the extended configuration and the retracted configuration in response to movement of the button and the stopper along an axis of the channel.

19. The plug assembly of claim 17, wherein the post further defines a shoulder extending radially inwardly at the channel, the shoulder being configured to transition the multiple arms between the extended configuration and the retracted configuration in response to movement of the button and the stopper along an axis of the channel.

20. The plug assembly of claim 17, further comprising a spring configured to bias the stopper toward the extended configuration.

* * * * *